United States Patent [19]

Stoldt et al.

[11] Patent Number: 4,673,412

[45] Date of Patent: Jun. 16, 1987

[54] FUEL ADDITIVE COMPRISING A METAL COMPOUND AND AN OXIME AND FUEL COMPOSITIONS CONTAINING SAME

[75] Inventors: Stephen H. Stoldt, Concord Township, Lake County; Reed H. Walsh, Mentor, both of Ohio

[73] Assignee: The Lubrizol Corporation, Wickliffe, Ohio

[21] Appl. No.: 779,749

[22] Filed: Sep. 24, 1985

[51] Int. Cl.[4] ..... C10L 1/18

[52] U.S. Cl. ..... 44/68; 556/37

[58] Field of Search ..... 44/68; 556/37

[56] References Cited

U.S. PATENT DOCUMENTS

| | | | |
|---|---|---|---|
| 2,338,578 | 1/1944 | Downing et al. | 44/68 |
| 2,560,542 | 7/1951 | Bartleson et al. | 252/32.7 |
| 3,348,932 | 10/1967 | Kukin et al. | 44/4 |
| 3,579,556 | 5/1971 | Briggs et al. | 556/37 |
| 3,649,659 | 3/1972 | Otto et al. | 44/68 |
| 3,925,472 | 12/1975 | Swanson et al. | 560/566 |
| 3,981,966 | 9/1976 | Baurom | 423/104 |
| 4,020,106 | 4/1977 | Ackerly et al. | 560/566 |
| 4,028,412 | 6/1977 | Gehlhaus et al. | 556/37 |
| 4,043,882 | 8/1977 | Skarbo et al. | 204/106 |
| 4,093,614 | 6/1978 | Chibnik et al. | 260/299 |
| 4,142,952 | 3/1979 | Dalton et al. | 204/106 |
| 4,205,960 | 6/1980 | Bryant | 44/68 |
| 4,266,945 | 5/1981 | Karn | 44/68 |
| 4,343,740 | 8/1982 | Bryant | 44/68 |
| 4,357,149 | 11/1982 | West et al. | 44/68 |
| 4,393,179 | 7/1983 | Hoppe et al. | 525/490 |
| 4,495,327 | 1/1985 | Schenck et al. | 524/556 |

FOREIGN PATENT DOCUMENTS 2098086 3/1982 United Kingdom .

*Primary Examiner*—Mrs. Y. Harris-Smith

*Attorney, Agent, or Firm*—James L. Cordek; Denis A. Polyn; Joseph P. Fischer

[57] ABSTRACT

A fuel composition containing a fuel additive which comprises a metal compound has been developed which fuel composition is stable upon storage. It has been discovered that a fuel additive comprising a metal compound and an oxime does not degrade a fuel, e.g. heating fuel oil, diesel fuel and the like, upon storage. Fuel additives containing metal compounds to function, e.g., as an agent to reduce soot formation and generally improve the combustion properties of the fuel may be added to fuels and stored without the build-up of gummy deposits and sludge in the storage container.

25 Claims, No Drawings

FUEL ADDITIVE COMPRISING A METAL COMPOUND AND AN OXIME AND FUEL COMPOSITIONS CONTAINING SAME

BACKGROUND OF THE INVENTION

1. Field of the Invention

This invention relates generally to novel fuel additives and fuel compositions containing these additives. More specifically, the invention relates to a storage stable fuel composition comprising a major amount of a fuel and a minor amount of a metal compound and an oxime.

2. State of the Art

The use of various metal compounds, particularly transition metal compounds such as compounds of manganese, lead, copper, zinc, cobalt and nickel, to name a few, in fuels to reduce soot formation and improve combustion properties of the fuel has been well documented. For example, in U.S. Pat. No. 2,338,578, the use of chromium soaps over other transition metal compounds in heating fuel oil is disclosed for the purpose of improving the combustion characteristics of the fuel oil. In U.S. Pat. No. 2,560,542, the use of combinations of two separate transition elements in a dispersible form in fuels to improve the combustion characteristics of the fuel is disclosed. U.S. Pat. No. 3,348,932 discloses a very specific combination of metal compounds to improve the combustion characteristics of fuels and reduce soot formation.

The problem associated with adding such metal compounds to fuels, as disclosed in the foregoing patents, is that the fuel is not stable upon storage. Fuels containing such metal compounds will form gummy or sludge deposits upon storage due to the catalyzed degradation of the fuel in the presence of the metal compound. Solutions to this problem other than adding antioxidants to the fuel, which for a variety of reasons is impractical, is to use a combination of metal compounds such as suggested in U.S. Pat. Nos. 2,338,578 and 3,348,932, discussed above. As disclosed patents, however, this approach does not avoid the problem entirely but only gives limited storage stability and represents an expensive alternative.

Another alternative for solving the problem is disclosed in the United Kingdom Patent Application No., 2,098,086A, which discloses a filtering apparatus. It is disclosed that a powdery transition metal compound, (e.g., cuprous chloride) is metered in a specific quantity to the exhaust gas upstream of the filtering apparatus. This solution clearly is not as economical or desirable as admixing an additive to a fuel in a storage container. Other alternatives or solutions to this problem are not found in the art.

Metal complexes of nitrogen compounds for use in lubricant and fuel compositions are known and disclosed in the literature. In U.S. Pat. No. 4,093,614, for example, multiple metal complexes of amine compounds are disclosed. One of the amine complexing agents may be a Mannich base.

U.S. Pat. No. 4,393,179 discloses a synthetic resin containing a metal complex which is derived from a Mannich base and an epoxide resin. These resins find use as a film forming component in various electrocoating lacquers and other coatings. U.S. Pat. No. 4,495,327 also discloses an electrocoating composition wherein the binder is a metal complex resin derived from various vinyl monomers and a complexing ligand such as oximes, dioximes, amines and Mannich bases.

The use of oximes as chelating agents or complexing agents for metal compounds and particularly for use in the extraction or recovery of various metal values from various waste streams has also been well documented. U.S. Pat. Nos. 3,981,966; 3,925,472; 4,020,106; 4,043,882; and 4,142,952 and C & EN, Jan. 14, 1985, pages 58 and 59, all disclose various oximes used to extract metal ions, particularly copper, nickel and zinc from various liquid streams.

None of the above-discussed patents and publications disclose nor even suggest the invention disclosed and claimed herein, i.e., an improved fuel composition comprising a major amount of a fuel and a minor amount of a metal compound and an oxime.

SUMMARY OF THE INVENTION

In accordance with the present invention, a novel composition of a metal complex of a Mannich base and an oxime has been discovered.

Further, in accordance with the invention, novel fuel compositions containing a major amount of a fuel and a minor amount of a metal compound and an oxime have also been developed.

Still further, in accordance with the invention, novel fuel additive concentrates comprising an organic solvent or diluent and from about 10% to about 99% by weight of a metal compound and an oxime have been developed.

Still further, in accordance with the invention, it has been found that a storage stable fuel containing metal compounds may be obtained by admixing a storage stable effective amount of a metal compound and an oxime with a fuel.

These and other aspects of the invention will become clear to those skilled in the art upon the reading and understanding of the specification.

DETAILED DESCRIPTION OF THE INVENTION

A novel fuel additive composition has been developed for fuels, particularly diesel fuels and other such distillate fuels or residual fuels. The fuel additive of the present invention is highly effective in lowering the ignition temperature of soot that may be formed upon the combustion of the fuel in an engine. Furthermore, it has been discovered that this fuel additive surprisingly does not degrade the fuel to any appreciable extent upon storage. It has been found that a fuel comprising a metal compound and an oxime is stable upon storage and is highly effective in reducing soot formation in the exhaust gas of an internal combustion engine.

The metal compounds, which are usable in the present invention, may be of inorganic nature or organic nature. By inorganic nature, it is intended to include those metal compounds wherein the anionic portion of the compound or the complexing ligand either does not contain carbon or is not hydrocarbon based and is generally water soluble. By organic nature, it is intended to include those compounds wherein the anionic portion of the compound or the complexing ligand is primarily hydrocarbon based and are generally oil-soluble or oil-dispersible.

While it is recognized that some metal compounds are more problematic than others when used in a fuel composition, e.g., note the disclosure of U.S. Pat. No. 3,348,932 discussed above, the metal compounds of the present invention may be derived from metals pf Groups VB, VIB, VIIB, VIII, IB, IIB, IIIA & IVA of the Periodic Table (CAS version). Transition metal compounds are preferred wherein metal compounds of copper, nickel, manganese, iron and cobalt or combinations thereof are more preferred for the purposes of the present invention. Lead compounds, although generally not considered a transition metal have been found to be useful for the purposes of this invention. Copper compounds are the most preferred. In selecting a metal compound usable in the present invention, the primary consideration is obtaining a storage-stable fuel containing the metal compound as well as the effectiveness of the metal compound in performing its desired function or purpose. It should be recognized, however, that such factors as availability, economics and the effect on the chemistry of other additives that may be present in the fuel will affect the final selection of the particular metal compound. These factors, however, are well recognized in this technology.

The anionic portion or complexing ligand of the metal compound is not particularly critical to the present invention. As previously pointed out, the anionic portion or complexing ligand may be of an inorganic nature or an organic nature. More specifically, there may be mentioned as the anionic portion, oxides, hydroxides, halides, carbonates, sulfites, sulfates, nitrates, nitrites, organo sulfonates, organo sulfoxides, phosphates, phosphites, organo phosphonates, organo phosphoryl, thiolates, alkoxides, organo-nitrogen based radicals such as amines, amido and the like. Other hydrocarbon-based groupings that may be mentioned are alkoxides, carboxylates, keto and aldehydes. The foregoing is not intended to be exclusive of the possible anionic groups or complexing ligands but only represen-tative of such groupings that may make up the metal compound within the context of this invention.

Nitrogen-based organo anionic radicals or complexing ligands and carboxylic acid derived anionic radicals or complexing ligands are preferred for the purposes of the present invention. Exemplary metal compounds containing such anionic radicals are disclosed in U.S. Pat. No. 2,560,542, which disclosure is herein incorporated by reference. For example, succinates, oleates, naphthenates, and the like have been found particularly useful within the scope of this invention. Such anionic groups may be unsubstituted or hydrocarbyl substituted groups. The term hydrocarbyl, as used herein, is further discussed and defined below.

Also, metal compounds containing amines or amine-based radicals, such as is disclosed in U.S. Pat. No. 4,093,614 and which disclosure is herein incorporated by reference, are preferred. Mannich based radicals have been found to be particularly useful in the present invention.

A preferred metal compound useful for the purposes of the present invention is a transition metal complex of a Mannich base which is the reaction product of:

(A) a compound having the formula $$(R')_n-\overset{\overset{\displaystyle R^0}{|}}{Ar}-(XH)_m$$

wherein Ar is an aromatic group or a coupled aromatic group, wherein m is 1, 2 or 3, wherein n is an integer from 1 to 4, wherein $R^1$, independently, is hydrogen or a hydrocarbyl having from 1 to about 100 carbon atoms, and wherein R° is hydrogen, amino, or carboxyl, and wherein X is 0, S, or both when m is 2 or greater;

(B) a compound having the formula $$R^2-\overset{\overset{\displaystyle O}{\|}}{C}-R^3$$

or a precursor thereof wherein $R^2$ and $R^3$, independently, are hydrogen, a saturated hydrocarbon group having from 1 to about 18 carbon atoms, or wherein $R^3$ is a carbonyl containing hydrocarbon group having from 1 to 18 carbon atoms;

(C) a hydroxyl-containing amine compound, a thiol containing amine compound, or a hydroxyl-thiol containing amine compound; with at least one (D) transition metal containing agent.

The (A) hydrocarbyl substituted hydroxyl and/or thiol containing aromatic compound of the present invention generally has the formula $(R^1)_n$—Ar—$(XH)_m$ where Ar is an aromatic group such as phenyl or polyaromatic group such as naphthyl, and the like. Moreover, Ar can be coupled aromatic compounds such as naphthyl, phenyl, etc. where the coupling agent is O, S, $CH_2$, a lower alkylene group having from 1 to about 6 carbon atoms, NH, and the like with R' and XH generally being pendant from each aromatic group. Examples of specific coupled aromatic compounds include diphenyl amine, diphenyl methylene and the like. The number of "m" XH groups is usually from 1 to 3, desirably 1 or 2, with 1 being preferred. The number of "n" substituted $R^1$ groups is usually from 1 to 4, desirably 1 or 2 with a single substituted group being preferred. X is 0 and/or S with O being preferred. That is, if m is 2, X can be both O, both S, or one 0 and one S. $R^1$ can be a hydrogen or a hydrocarbyl-based substitutent having from 1 to about 100 carbon atoms. As used herein and throughout this specification, the term "hydrocarbyl-based substituent" or "hydrocarbyl" denotes a substituent having carbon atoms directly attached to the remainder of the molecule and having predominantly hydrocarbyl character within the context of this invention. Such substituents include the following:

1. Hydrocarbon substituents, that is, aliphatic (for example alkyl or alkenyl), alicyclic (for example cycloalkyl or cycloalkenyl) substitutents, aromatic-, aliphatic- and alicyclic-substituted aromatic nuclei and the like, as well as cyclic substituents wherein the ring is completed through another portion of the molecule (that is, any two indicated substitutents may together form an alicyclic radical).

2. Substituted hydrocarbon substituents, that is, those containing non-hydrocarbon radicals which, in the context of this invention, do not alter the predominantly hydrocarbyl character of the substituent. Those skilled in the art will be aware of suitable radicals (e.g., halo, (especially chloro and fluoro), amino, alkoxyl, mercapto, alkylmercapto, nitro, nitroso, sulfoxy, etc.).

3. Hetero substituents, that is, substituents which, while predominantly hydrocarbon in character within the context of this invention, contain atoms other than carbon present in a chain or ring otherwise composed of carbon atoms.

$R^1$ is hydrogen, or said hydrocarbyl having from 1 to about 100 carbon atoms such as an alkyl, or an alkyl having from 1 to about 30 carbon atoms, more desirably from about 7 to about 20 carbon atoms, an alkenyl having 2 to about 30 carbon atoms, more desirably from about 8 to about 20 carbon atoms, a cycloalkyl having from 4 to about 10 carbon atoms, an aromatic group having from about 6 to about 30 carbon atoms, an aromatic substituted alkyl or alkyl substituted aromatic having a total of from about 7 to about 30 carbon atoms and more desirably from about 7 to about 12 carbon atoms. The hydrocarbon-based substituent preferably is an alkyl having from 7 to about 20 atoms with from about 7 to about 14 carbon atoms being highly preferred. Examples of suitable hydrocarbyl substituted hydroxyl containing aromatics include the various naphthols, and more preferably, the various alkyl substituted cathechols, resorcinols, and hydroquinones, the various xylenols, the various cresols, aminophenols, and the like. Examples of various suitable (A) compounds include heptylphenol, octylphenol, nonylphenol, decylphenol, dodecylphenol, tetrapropylphenol, eicosylphenol, and the like. Dodecylphenol, tetrapropylphenol and heptylphenol are especially preferred. Examples of suitable hydrocarbyl substituted thiol containing aromatics include heptylthiophenol, octylthiophenol, nonylthiophenol, dodecylthiophenol, tetrapropylthiophenol, and the like. Examples of suitable thiol and hydroxyl containing aromatics include dodecylmonothioresorcinol.

The (B) compound of the present invention has the formula

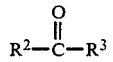

or a precursor thereof. $R^2$ and $R^3$, independently, can be hydrogen, a hydrocarbon such as an alkyl having from 1 to 18 carbon atoms and more preferably 1 or 2 carbon atoms. The hydrocarbon can also be a phenyl or an alkyl substituted phenyl having from about 1 to about 18 carbon atoms and more preferably from about 1 to about 12 carbon atoms. Examples of suitable (B) compounds include the various aldehydes and ketones such as formaldehyde, acetaldehyde, propionaldehyde, butyraldehyde, valeraldehyde, benzaldehyde, and the like, as well as acetone, methyl ethyl ketone, ethyl propyl ketone, butyl methyl ketone, glyoxal, glyoxylic acid, and the like. Precursors of such compounds which react as aldehydes under reaction conditions of the present invention can also be utilized and include paraformaldehydes, formalin and the like. Formaldehyde and its polymers, for example, paraformaldehyde are preferred. Naturally, mixtures of the various (B) reactants can be utilized.

It is an important aspect of the present invention to utilize a (C) hydroxyl and/or thiol containing amine compound, with the hydroxyl containing compound being preferred. The amino group is desirably a primary amine or a secondary amine. Generally, the thiol and/or hydroxyl containing amine compound has from 1 to about 10 primary or secondary amine groups therein and may contain from 1 to about 10 thiol groups therein, and/or from 1 to about 10 hydroxyl groups therein. Desirably, such a compound contains one or two amine groups as well as one or two thiol groups and/or one or two hydroxyl groups therein. Representative examples of thiol containing amine compounds include 2-mercaptoethyl amine, N-(2-mercaptoethyl)ethanol amine, and the like.

The preferred hydroxyl containing amine compound can be a cyclohydrocarbyl hydroxyl containing amine, a compound having the formula $HO\text{-}R^4\text{—}NH_2$ or a compound having the formula

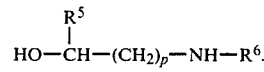

The cyclohydrocarbyl compound can contain from 1 to 10 hydroxyl groups, and preferably one or two. Desirably, the hydroxyl group is pendant from the ring structure. The number of amino groups is from about 1 to about 10 with one amino group being preferred. The amino group is also desirably pendant from the ring structure. The number of carbon atoms in the cyclohydrocarbyl group is from 3 to 20, with a cycloalkyl having from 3 to 6 being preferred. Examples of such cyclohydrocarbyl hydroxyl containing amines include 2-aminocyclohexanol, and hydroxy-ethyl, aminopropylmorpholine.

In the compound having the formula $HO\text{-}R^4\text{—}NH_2$, $R^4$ is a hydrocarbylene, having from 1 to 20 carbon atoms. $R^4$ can be linear, branched, and the like. Desirably, $R^4$ is an alkylene having from 2 to about 6 carbon atoms, and preferably has 2 or 3 carbon atoms.

Considering $R^5$ of the formula

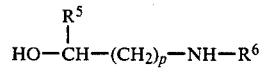

it is hydrogen or a hydrocarbyl having from 1 to about 20 carbon atoms. $R^5$ can be linear, branched or the like. Desirably $R^5$ is alkyl having from 1 to about 20 carbon atoms and more desirably from 1 to about 2 carbon atoms. Preferably, $R^5$ is a hydrogen atom. The number of repeating units, that is "p", is 1 to 10 with 1 being preferred. $R^6$ is a hydrogen atom, a hydroxyl containing hydrocarbyl having from 1 to about 20 carbon atoms, a hydrocarbyl primary amino group having 1 to about 20 carbon atoms or a hydrocarbyl polyamino group having from 1 to about 20 carbon atoms. Desirably, the hydroxyl containing hydrocarbyl group is an alkyl containing from 1 to 20 carbon atoms, desirably 2 or 3 carbon atoms with 2 carbon atoms being preferred. Desirably, the hydrocarbyl containing amino group is an alkyl amino group such as a primary amino group containing from 1 to 20 carbon atoms, more desirably 2 or 3 carbon atoms with 2 carbon atoms being preferred. The hydrocarbyl containing polyamino group desirably is an alkyl group containing from 1 to 20 carbon atoms with 2 or 3 carbon atoms being preferred. This compound can contain a total of 1 to 10 amino groups with 1 or 2 amino groups being preferred. Taken together, $R^5$ and $R^6$ has a total number of 24 carbon atoms or less.

Examples of said (C) hydroxyl containing amine compounds include both mono- and polyamines provided that they contain at least one primary or secondary amino group. Examples of specific hydroxyl containing amines include ethanolamine, di-(3-hydroxypropyl)-amine, 3-hydroxybutyl-amine, 4-hydroxybutylamine, diethanolamine, di-(2-hydroxypropyl)-amine, N-(hydroxypropyl)-propylamine, N-(2-hydroxyethyl)-cyclohexylamine, 3-hydroxycyclopentylamine, N,N,$N^1$-tri-(2-hydroxyethyl)ethylenediamine, N-hydroxyethyl piperazine, and the like.

Also contemplated are other mono- and poly-N-hydroxyalkyl-substituted alkylene polyamines; especially those containing 2 to 3 carbon atoms in the alkylene radicals and alkylene polyamines containing up to 7 amino groups such as the reaction product of about 2 moles of propylene oxide and 1 mole of diethylenetriamine.

Amino alcohols containing primary amines as set forth in the above formula containing $R^4$ are described in U.S. Pat. No. 3,576,743 and is hereby fully incorporated by reference. Specific examples of hydroxy-substituted primary amines include 2-amino-1-butanol, 2-amino-2-methyl-1-propanol, 2-amino-1-propanol, 3-amino-2-methyl-1-propanol, 3-amino-1-propanol, 2-amino-2-methyl-1, 3-propanediol, 2-amino-2-ethyl-1,3-propanediol, N-beta-hydroxypropyl-N'-beta-aminoethyl-piperazine, tris(hydroxymethyl)aminomethane (also known as trismethylolaminomethane), 2-amino-3-butyn-1-01, ethanolamine, beta-(beta-hydroxy ethoxy)-ethyl amine, glucamine, glucosamine, 4-amino-3-hydroxy-3-methyl-1-butene (which can be prepared according to procedures known in the art by reacting isopreneoxide with ammonia), N-(3-aminopropyl)-4-(2-hydroxyethyl)-piperidine, 2-amino-6-methyl-6-hepanol, 5-amino-1-pentanol, N-(beta-hydroxyethyl)-1,3-diamino propane, 1,3-diamino-2-hydroxy-propane,N-(beta-hydroxy ethoxyethyl)-ethylenediamine, and the like. For further description of the hydroxy-substituted primary amines contemplated as being useful as (C), U.S. Pat. No. 3,576,743 is expressly incorporated herein by reference for its disclosures of such amines.

The (D) agent of the present invention contains a transition metal, that is a metal found in Groups VB, VIB, VIIB, VIII, IB, IIB, IIIA & IVA of the periodic table (CAS version). Any salt of a transition metal can be utilized. Thus, salts of carbonates, sulfates, nitrates, halogens, as for example, chlorides, oxides, hydroxides, combinations thereof and the like can be utilized. Such salts are known to the art as well as to the literature. Desirable transition metals include copper, iron, zinc, cobalt, nickel and manganese. Lead salts are also found to be useful within the scope of the invention. Additionally, various oil soluble salts can be utilized such as those derived from naphthenates and various carboxylates. That is, the salts can be derived from the reaction of the transition metals with soaps or fatty acids, saturated or unsaturated. The fatty acids generally have from about 8 to about 18 carbon atoms. An additional salt are the metal esters wherein the esters are lower aliphatic and desirably lower alkyl having from about 1 to about 7 carbon atoms. Examples of specific transition metals containing salts include zinc oxide, basic copper carbonate (also referred to as copper hydroxy carbonate), copper acetate, copper bromide, copper butyrate, copper chloride, copper nitrate, copper oxide, copper palmitate, copper sulfate, iron acetate, iron bromide, iron carbonate, iron chloride, iron hydroxide, iron nitrate, iron sulfate, manganese acetate, manganese bromide, manganese chloride, manganese sulfate, and the like. Preferred (D) agents include basic copper carbonate and copper acetate.

The preparation of the metal complexes of hydroxyl containing Mannich compounds can be carried out by a variety of methods such as in a single pot or a two pot preparation. The one pot method briefly relates to adding the (A) hydroxyl containing aromatic compound, the (B) saturated aldehyde or ketone, and (C) the hydroxyl and/or thiol containing amine compound to a suitable vessel and heating to carry out the reaction. Reaction temperatures of from about RT to about 200° C. can be utilized. During reaction, water is drawn off, e.g., by sparging. Desirably, the reaction is carried out in solvent such as an aromatic type oil. The amount of the various reactants utilized is desirably on a mole to mole basis of (A) and (B) for each (C) secondary amino group or on a two mole basis of (A) and (B) for each (C) primary amino group, although larger or smaller amounts can also be utilized. The (D) compound containing at least 1 transition metal is then added, typically in a slow manner since the reaction may be exothermic as well as to control foaming. The reaction by-products, such as carbon dioxide and water, are removed via suitable procedure such as sparging, usually at a temperature greater than the boiling water. However, the temperature is usually less than 150° C. inasmuch as the metal complex formed may be unstable at higher temperatures.

The "two pot" method is basically as set forth below although various modifications thereof can be practiced. The hydroxyl containing aromatic compound (A) and the hydroxyl and/or thiol containing amine compound (C) are added to a reaction vessel. The aldehyde or ketone (B) is generally rapidly added and the exothermic reaction generated is supplemented by mild heat such that the reaction temperature is from about 60° C. to about 90° C. Desirably, the addition temperature is less than the boiling point of water, otherwise, the water will bubble off and cause processing problems. After the reaction is essentially complete, the water by-product is removed in any conventional manner as by evaporation thereof which can be achieved by applying a vacuum, applying a sparge, heating or the like. A nitrogen sparge is often utilized as at a temperature of from about 100° C. to about 130° C.

The reaction is generally carried out in a solvent. Any conventional solvent can be utilized such as toluene, xylene or propanol. Oftentimes, various oils are utilized such as an aromatic type oil, 100 neutral oil, etc.

The amount of the various (A), (B), and (C) components is as set forth above. However, it is to be understood that larger or smaller amounts can be utilized. For example, for each primary amino group of (C) from about 0.5 to about 4 moles of (A) and (B) can be utilized and more desirably from about 1.8 to about 2.2 moles of (A) and (B). For each secondary amino group of (C), from about 0.2 to about 2 moles of (A) and (B) can be utilized and more desirably from about 0.9 to about 1.1 moles of (A) and (B).

The next step is the addition of at least one transition metal containing agent (D) to form a Mannich complex. Desirably, a promoter is utilized in association with the metal containing compound to free the metal so that it can react with the above reaction product. The promoter alternatively can be added before or after the metal addition. Since the formation of the metal complex may be exothermic, the metal containing compound is generally added in a slow manner, for example dropwise, to control foaming produced by the evolution of carbon dioxide as well as the formation of water. Generally, this reaction step is carried out at a temperature of from about room temperature to about 90° C. After sufficient time has elapsed such that the reaction is generally complete, water and any remaining carbon dioxide is removed by conventional methods such as by sparging at temperatures below that which renders the metal complex unstable. The unstable temperature of the various metal complexes will vary depending upon the type of compound with a guideline being approximately 150° C. Thus, sparging is generally kept below 130° C. and often under 120° C.

As noted above, promoters are often desirable to improve the rate of reaction of the metal containing compound. A basic promoter is desirable such as ammonium hydroxide. Generally, any conventional aqueous basic salt can be utilized which is known to the art and the literature with specific examples being potassium hydroxide, sodium hydroxide, sodium carbonate, and the like with ammonium hydroxide being preferred. The amount of promoter generally varies with regard to the type of metal as known to those skilled in the art.

The metal complex Mannich compounds of the present invention impart improved fuel stability and hence can be utilized in many applications. A particularly suitable use is as a diesel fuel additive. Upon utilization, that is during combustion, all the organic portions of the metal complex Mannich compound are essentially burned. The remaining metal portion of the compound has been found to reduce the ignition temperature of soot. Thus, soot is much more readily broken down or reacted at lower temperatures as in a particulate soot trap which is often utilized in association with diesel engines.

A general discussion of the preparation of the Mannich base metal complexes has been discussed above and is further generally discussed in U.S. Pat. No. 4,093,614 However, the following examples are provided as being further illustrative of the preparation of these compounds. These examples are provided for illustrative purposes only and do not limit the scope of the present invention where such limitations are reserved for the claims that follow.

EXAMPLE 1

A 12 liter, 4-neck flask with mechanical stirrer, thermowell, thermometer, nitrogen sparge, H-trap, and condenser is charged with dodecylphenol(3240 gram), an aromatic low boiling naphthenic solvent (2772 gram) and ethanolamine (380 ml). The mixture is stirred and heated to 72° C. and paraformaldehyde (372 gram) is rapidly charged thereto. The reaction temperature is increased to a maximum of 147° C. over a 1 hour period while sparging out water with nitrogen. A total of 218 ml of water is collected versus a theoretical amount of 230 ml. At 25° C., $Cu_2(OH)_2CO_3$ (663 gram) is then charged to the flask. The solution is warmed to 63° C. and aqueous ammonia (782 ml) is added. The reactants are warmed while sparging out water ($N_2$ at 1.0 SCFH). The maximum temperature achieved over a period of 8.5 hours is 122° C. The amount of water collected is 648 ml versus a theoretical amount of 662 ml. The reactants are then cooled and filtered and the desired product obtained. Yield is 6593 grams versus a theoretical amount of 6930 grams; that is 95%.

EXAMPLE 2

A 12 liter, 4 neck flask equipped with a mechanical stirrer, thermowell, thermometer, nitrogen sparge, H-trap, and condenser is charged with dodecyl phenol (3240 gram), an aromatic low boiling naphthenic solvent (2500 gram) and ethanolamine (362 ml). The reactants are stirred and heated to 70° C. and paraformaldehyde (372 gram) is charged rapidly to the solution. The solution is gradually heated while sparging with nitrogen. Maximum reaction temperature reached is 137° C. over a 5 hour period. 230 ml. of aqueous solution is collected. The reaction mixture is cooled to 30° C. and charged with aqueous ammonia (391 ml). With the heat source shut off, $Cu_2(OH)_2CO_3$ (663 gram) is gradually added over a 30 minute period. During the $Cu_2(OH)_2CO_3$ addition, the reaction gives an exotherm of about 30 to 47° C. The reaction temperature is then increased to about 70° C. with additional aqueous ammonia (195 ml) being rapidly charged. The solution temperature is gradually increased to collect water in the trap over a 4.5 hour period with a maximum temperature of about 121° C. A total 536 ml of water is collected versus the theoretical amount of 537 ml. The solution is cooled and is then filtered. A yield of 93% is achieved.

EXAMPLE 3

A 2 liter, 4 neck flask equipped with a mechanical stirrer, nitrogen sparge, H-trap, condenser and addition funnel is charged with 928 grams of a Mannich material as prepared in Example 1. The solution is heated to about 55° C. and $Cu_2(OH)_2CO_3$ is charged to the flask (no $CO_2$ evolution). When the temperature reached 60° C., aqueous ammonia is added over a 15 minute period. The temperature is gradually increased to a maximum of 120° C. over a 5 hour period while sparging. A total of 85 ml of water is collected in the trap versus a theoretical amount of 88 ml. The contents of the flask weighs 984 grams versus a theoretical amount of 979 grams indicating that some water still remained. The contents of the flask were filtered through a diatomaceous earth filter aid with water vapor being removed during filtration. The bottle filtrate is the preparation. A yield of 90% is achieved.

With respect to the oximes suitable for use according to the present invention, it is intended that practically any material containing the

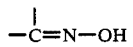

moiety may be useful for the purposes of the present invention. The oxime, according to the present invention, is preferably an oxime of the general formula

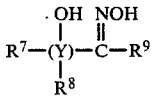

wherein $R^7$, $R^8$ and $R^9$ are independently hydrogen or hydrocarbyl and Y is an alkylene, cycloalkylene, an aromatic or substituted aromatic group with the proviso that the hydroxy group is attached to a carbon which is no more than 3 carbon atoms removed from the oximidoyl group.

The more preferred oximes are represented by the following formulas:

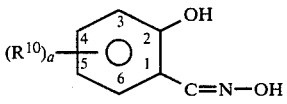

wherein $R^{10}$ is hydrocarbyl and a is 0, 1, 2, 3 or 4; and

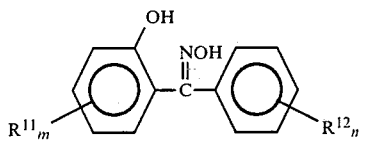

in which $R^{11}$ and $R^{12}$ may be individually alike or different and are hydrocarbyl and m and n are 0, 1, 2, 3 or 4. As to specific oxime species which are preferred according to the present invention, there may be mentioned 2-hydroxy-3-methyl-5-ethylbenzophenoneoxime, 5-heptylsalicylaldoxime, 5-nonylsalicylaldoxime, 2-hydroxyl-3,5-dinonylbenzophenoneoxime, 5-dodecylsalicylaldoxime, 2-hydroxy-5-nonylbenzophenoneoxime, 5-$C_{16}$ to $C_{200}$ polyisobutenylsalicylaldoxime and the like or combinations thereof.

The preparation for the above described oximes has been described in the literature and is disclosed in the aforementioned U.S. Pat. Nos. 3,981,966; 3,925,472; 4,020,106; 4,043,882; and 4,142,952 which disclosures as to the preparation of these compounds is incorporated herein by reference. The bulk of the oximes are prepared by converting the corresponding ketone or aldehyde with hydroxylamine or a precursor thereto, such as its various salts, e.g., hydrochloride salt, to the desired oxime.

It will be recognized that many of the metal compounds described herein and discussed above are commercially available and the methods for their preparation have been well documented in the literature. Preparation of several of these compounds, particularly the metal carboxylates from various fatty acids are described in U.S. Pat. Nos. 3,348,932; 2,338,578; and 2,560,542.

The metal compounds of the present invention, described above, are used in combination with the above-described oximes for later addition to a fuel as individual components or are often prepared as a concentrate for later blending to a fuel. According to the present invention, the metal compound and the oxime may be added separately to the fuel or as a blend or concentrate. The concentrate will comprise an organic solvent or diluent and from about 10% to about 99% by weight of the combination of the metal compound with the oxime. Aside from the substantially inert organic liquid diluent, the concentrate solution may also contain dispersants and other conventional additives. Examples of suitable dispersants include succinimides and the like. Suitable, inert, organic liquid diluents or solvents, which generally do not react with the metal compound and oxime, include aliphatic and aromatic hydrocarbons. Such hydrocarbon materials include naphthenic stocks, kerosene, textile spirits, benzene, toluene, xylene, alcohols, such as isopropanol, N-butanol, isobutanol, and 2-ethylhexanol, ethers, such as dipropyl ether, methylethylether or diethylether, mineral oils, synthetic oils and the like. Preferred diluents include mineral oils and aromatic naphtha. As previously mentioned, other additives can be utilized in the concentrate, however, the above described additives are desired. While the concentrate may be made up of about 10% to about 99 weight percent of the metal compound combined with the oxime, generally about 25 to about 75 weight percent of the metal compound combined with the oxime is preferred. The metal compound and oxime composition of the present invention is generally utilized as an additive for various fuel compositions. Such fuel compositions have varying boiling ranges, viscosities, cloud and pour points, etc. Accordingly, their end use is well known to those skilled in the art. Among such fuels are those commonly known as diesel fuels, distillate fuels, heating oils, residual fuels, bunker fuels and the like. The properties of such fuels are well known to the art as illustrated for, example by ASTM SPECIFICATION D396-73. As previously discussed, a preferred use for these additives is in association with diesel fuels which give good storage stability and at the same time effectively reduce the ignition temperatures for soot particulate.

As indicated previously, the metal compound and oxime may be added together in a blend or a concentrate or separately to a fuel composition. The manner or mechanism by which these materials are blended or added to the fuel is not critical and any conventional technique may be utilized. The amount of the additive composition to the fuel, i.e., the combined amount of metal compound and oxime, is dependent upon the particular function or purpose of the additive in the fuel and must be added in an amount which is effective for that function. For example, if the function of the additive composition is to lower the ignition temperature of soot produced from the combustion of fuel, then the amount of additive composition added to the fuel should be an amount effective to lower the ignition temperature of the soot. For this particular function or utility, it is the particular metal which affects the lowering of the ignition temperature of the soot, i.e., effects the reduction of soot formation. Thus, the amount of the additive composition added to the fuel will be based on the metal concentration. For this function, generally from about 1 to about 500 ppm of the metal is required to effectively lower the ignition temperature of soot. Preferably, from about 10 to about 250 ppm of the metal is required and most preferably from about 30 ppm to about 125 ppm is most desirable. It should be recognized, however, that the concentration of the metal added to the fuel will vary depending upon the particular metal compound as well as the particular fuel to which it is being added.

The relative amount of the metal compound to oxime which makes up the fuel additive composition should be a proportion effective to give a storage-stable fuel composition. In other words, there should be a sufficient amount of oxime combined with the metal compound such that there is no appreciable degradation of the fuel which results in gummy deposits or sludge build up in the particular fuel storage container. Without intending to be bound by such, generally the amount of metal compound to oxime will range from about 1 mole of metal compound to about 10 moles of oxime to about 1 mole of metal compound to about 0.1 mole of oxime. Preferably, the amount of metal compound to oxime will range from about 1 mole of metal compound to about 5 moles of oxime to about 1 mole of metal compound to about 0.5 moles of oxime. Most preferably, the amount of metal compound to oxime will range from about 1 mole of metal compound to about 2.5 moles of oxime to about 1 mole of metal compound to about 1 mole of oxime.

The following examples are provided to illustrate the storage stability of fuels containing the fuel additive compositions of the present invention. Again, it is emphasized that these examples are provided for illustrative purposes only and are not to serve as a limitation on the scope of the invention where such scope is set out solely in the claims.

STORAGE STABILITY TEST

The storage stability of different fuels containing the additive composition of the present invention was tested. Various fuels were treated with different fuel additive compositions according to the present invention. The treated fuels were subjected to two separate stability tests. One of these tests is a severe oxidation stability test of distillate fuels designated and set out as ASTM D2274. The other test to which the fuel compositions were subjected were 110° F./13 week distillate fuel oil storage stability test. The procedure for the first test was according to the ASTM designation and the test for the 110° F./13 week test is set out below.

Procedure:

1. Measure the initial color of the fuel oil to be tested via ASTM method D1500.
2. Place 400 ml of clean, dry, distillate fuel oil into a clean 500 ml Erlenmeyer flask.
3. Purge the fuel oil sample with air for a period of two minutes. The procedure should be carried out with a sparging tube to ensure proper aeration of the sample.
4. Cover the top of the Erlenmeyer with aluminum foil. Then make a $\frac{1}{8}''$ diameter perforation in the center of the foil to allow continuous air/sample contact.
5. Place the covered sample in a laboratory oven set to 110° F. for a period of 13 weeks.
6. After the 13 week period has elapsed, remove the sample from the oven and measure the color as per ASTM D1500 procedure.
7. When the final color has been measured, filter 350 ml of the fuel through a tared 5 micron millipore filter. All weights should be made to the nearest 0.1 mg.
8. Reweigh the filter and determine the mg of insoluble residue per 100 ml of oil by the equation provided below.

$$A=(B-C)/3.5$$

Where:

A = Insoluble residue mg/100 ml

B = Final filter weight, mg

C = Initial filter weight, mg.

The results of these tests are set out in the following tables.

TABLE I[1]

| Additive Formulation | Metal Compound | Metal Compound Conc. ppm | Oxime | Oxime conc. ppm | Molar Ratio | Concentration of Metal in Fuel |
|---|---|---|---|---|---|---|
| A | Product of Example 1 | 1,404 | 5-dodecylsalicyl-aldoxime | 984 | 1:2.0 | 61.5 ppm |
| B | Product of Example 1 | 1,404 | 5-dodecylaldoxime | 1,180 | 1:2.2 | 61.5 ppm |
| C | Product of Example 1 | 1,404 | 5-nonylsalicyl-aldoxime | 542 | 1:2.0 | 61.5 ppm |
| D | Product of Example 1 | 1,404 | 5-nonylsalicyl-aldoxime | 650 | 1:2.2 | 61.5 ppm |
| E[3] | Mooney[2] 12% Cu CEM-ALL TM | 514 | 5-dodecylsalicy-aldoxime | 984 | 1:2.0 | 61.5 ppm |
| F[3] | Mooney[2] 12% Cu CEM-ALL TM | 514 | 5-nonylsalicyl-aldoxime | 542 | 1:2.0 | 61.5 ppm |
| G[3] | Same as A | | | | | |
| H[3] | Same as C | | | | | |

1. This Table sets out the different fuel additive compositions of the present invention tested in the storage stability tests.
2. a copper carboxylate salt of mixed $C_8$ to $C_{10}$ fatty acids.
3. prepared as a concentrate blend.

TABLE II

| | 110° - 13 WEEK STABILITY TEST | | | | | |
|---|---|---|---|---|---|---|
| | No. 2 Fuel Oil | | | Reference Diesel Fuel | | |
| | ASTM[1] Color | | Insolubles | ASTM[1] Color | | Insolubles |
| Formulation 1 | Initial | @ 13 wks | mgs/mls | Initial | @ 13 wks | mgs/mls |
| A | L3.0 | L3.5 | 0.21 | L3.5 | L5.0 | 5.60 |
| B | L3.0 | L3.0 | 0.29 | L3.0 | L4.0 | 0.87 |
| C | L2.5 | L3.5 | 1.02 | L3.0 | L4.0 | 0.72 |
| D | L2.5 | L3.5 | 0.53 | L3.0 | L4.0 | 0.72 |
| E | L2.5 | L4.0 | 35.08 | L3.5 | L3.5 | 68.77 |
| F | L2.5 | L5.5 | 86.90 | L3.5 | L3.5 | 55.63 |
| G | L2.5 | L3.5 | 0.40 | L3.5 | L4.5 | 1.84 |
| H | L2.5 | L3.5 | 0.68 | L3.5 | L4.5 | 1.26 |

[1]ASTM D1500

TABLE III

| Additive | Treatment Level (ppm) | ASTM D 2274 STABILITY TEST Diesel Fuel A — ASTM D1500 Color Initial | Final | Filter Insolubles (mg/100 ml) |
|---|---|---|---|---|
| None | — | L3.0 | L4.5 | 2.64 |
| [1]Product of Example 1 | 1,404 | L3.0 | L5.0 | Filter clogged after 90 ml |
| A | 1,404 + 984 | L3.0 | L4.5 | 1.96 |
| B | 1,404 + 1,180 | L3.0 | L4.0 | 1.34 |
| C | 1,404 + 542 | L3.0 | L4.5 | 1.56 |
| D | 1,404 + 650 | L3.0 | L4.5 | 1.60 |

[1]Contained no oxime

TABLE IV

| Additive | Treatment Level (ppm) | ASTM D 2274 STABILITY TEST Diesel Fuel B — ASTM D1500 Color Initial | Final | Filter Insolubles (mg/100 ml) |
|---|---|---|---|---|
| None | — | L3.0 | L4.5 | 2.49 |
| [1]Product of Example 1 | 1,404 | L3.5 | L5.0 | Filter clogged after 110 ml |
| A | 1,404 + 984 | L3.0 | L4.5 | 1.20 |
| B | 1,404 + 1,180 | L3.5 | L4.5 | 1.14 |
| C | 1,404 + 542 | L3.0 | L5.0 | 0.80 |
| D | 1,404 + 650 | L3.0 | L4.5 | 1.23 |

[1]Contained no oxime

TABLE V

| Additive | Treatment Level (ppm) | ASTM D 2274 STABILITY TEST Diesel Fuel C — ASTM D2274 — ASTM D1500 Color Initial | Final | Filter Insolubles (mg/100 ml) |
|---|---|---|---|---|
| None | — | L1.5 | L3.0 | 1.99 |
| [1]Product of Example 1 | 1,404 | L2.0 | L4.5 | Filter clogged |
| A | 1,404 + 984 | L2.0 | L3.0 | 0.92 |
| B | 1,404 + 1,180 | L2.0 | L3.0 | 0.96 |
| C | 1,404 + 542 | L2.0 | L3.0 | 1.00 |
| D | 1,404 + 650 | L2.0 | L3.0 | 1.75 |

[1]Contained no oxime

TABLE VI

| Additive | Treatment Level (ppm) | ASTM D 2274 STABILITY TEST Diesel Fuel A — ASTM D2274 — ASTM D1500 Color Initial | Final | Filter Insolubles (mg/100 ml) |
|---|---|---|---|---|
| None | — | L3.0 | L4.0 | 2.09 |
| [1]Product of Example 1 | 1,404 | L3.0 | L5.0 | Filter clogged |
| B | 1,404 + 1,180 | L3.0 | L4.5 | 1.06 |
| D | 1,404 + 650 | L3.5 | L4.0 | 0.97 |

[1]Contained no oxime

TABLE VII

| ASTM D 2274 STABILITY TEST Diesel Fuel B | | | | |
|---|---|---|---|---|
| | | ASTM D2274 | | |
| | Treatment | ASTM D1500 Color | | Filter Insolubles |
| Additive | Level (ppm) | Initial | Final | (mg/100 ml) |
| None | — | L3.0 | L4.5 | 3.58 |
| [1]Product of Example 1 | 1,404 | L3.5 | L5.0 | Filter clogged |
| B | 1,404 + 1,180 | L3.0 | L4.5 | 1.28 |
| D | 1,404 + 650 | L3.0 | L4.5 | 0.91 |

[1]Contained no oxime

TABLE VIII

| ASTM D 2274 STABILITY TEST No. 2 Fuel Oil | | | | |
|---|---|---|---|---|
| | | ASTM D2274 | | |
| | Treatment | ASTM D1500 Color | | Filter Insolubles |
| Additive | Level (ppm) | Initial | Final | (mg/100 ml) |
| None | — | L2.0 | L2.5 | 1.15 |
| [1]Product of Example 1 | 1,404 | L3.0 | — | Filter clogged |
| A | 1,404 + 984 | L2.5 | L3.5 | 0.46 |
| B | 1,404 + 1,180 | L2.5 | L3.5 | 0.17 |
| C | 1,404 + 542 | L2.5 | L3.5 | 1.09 |
| D | 1,404 + 650 | L2.5 | L3.5 | 0.32 |

[1]Contained no oxime

As can be readily seen from the results of these tests, the storage stability of fuels containing metal compounds such as copper compounds is greatly enhanced by the additive composition according to the present invention. In other words, the storage stability of these different fuels containing a metal compound plus an oxime is markedly greater than fuels which contain only a metal compound and even fuels containing no additive.

While the invention has been described and illustrated with reference to certain preferred embodiments thereof, those skilled in the art will appreciate that various changes, modifications and substitutions can be made therein without departing from the spirit of the invention. For example, the relative amounts of the different components of the additive composition other than the preferred range as set forth hereinabove may be applicable as a consequence of the variations in the types of fuels or particular engines in which they are to be used. It is intended, therefore, that the invention be limited only by the scope of the claims which follow.

What is claimed is:

1. A composition comprising:

(I) an oil-soluble, transition metal complex of a Mannich base, and (II) an oxime wherein the molar ratio of I:II is from about 1:10 to about 10:1.

2. The composition according to claim 1 wherein the oil-soluble, transition metal complex of a Mannich base is a reaction product of:

(A) a compound having the formula

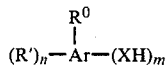

wherein Ar is an aromatic group or a coupled aromatic group, wherein m is 1, 2 or 3, wherein n is an integer from 1 to 4, and wherein $R^1$, independently, is hydrogen or a hydrocarbyl having from 1 to about 100 carbon atoms wherein R° is hydrogen, amino, or carboxyl, and wherein X is O, S, or both when m is 2 or greater;

(B) a compound having the formula

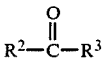

or a precursor thereof wherein $R^2$ and $R^3$, independently, is hydrogen, a saturated hydrocarbon group having from 1 to about 18 carbon atoms, or wherein $R^3$ is a carbonyl containing hydrocarbon groups having from 1 to 18 carbon atoms;

(C) a hydroxyl-containing amine compound, a thiol containing amine compound, or a hydroxyl-thiol containing amine compound; with at least one (D) transition metal containing salt.

3. The composition according to claim 2 wherein $R^1$ of said (A) compound is hydrogen, or an alkyl having from 1 to about 30 carbon atoms, a cycloalkyl having from 4 to about 10 carbon atoms, an alkenyl having from 2 to about 30 carbon atoms, an aromatic or an alkyl-substituted aromatic having from about 7 to about 30 carbon atoms, or an aromatic-substituted alkyl having from about 7 to about 30 carbon atoms, and wherein said coupling agent of said coupled Ar group is O, S, NH or a lower alkylene.

4. The composition according to claim 3 wherein said (C) compound is said hydroxyl containing amine having from 1 to about 10 hydroxyl groups therein and from 1 to about 10 amine groups therein, or said hydroxyl-thiol containing amines having from 1 to about 10 hydroxyl groups therein, from 1 to about 10 thiol groups therein and from 1 to about 10 amine groups therein; wherein $R^2$ and $R^3$ of said (B) compound, independently, is hydrogen, an alkyl phenyl or an alkyl-substituted phenyl wherein said alkyl contains from 1 to 18 carbon atoms or $R^3$ is a carboxyl containing alkyl wherein said alkyl has from 1 to 18 carbon atoms.

5. The composition according to claim 4 wherein said (C) hydroxyl containing amine is a compound having the formula $$HO-R^4-NH_2$$

or a compound having the formula $$HO-\overset{\overset{R^5}{|}}{CH}-(CH_2)_p-NHR^6{}_1$$

or a cyclohydrocarbyl hydroxyl containing amine having from 3 to 20 carbon atoms, wherein $R^4$ is a hydrocarbyl having from 1 to about 20 carbon atoms, wherein $R^5$ is hydrogen or a hydrocarbyl having from 1 to about 20 carbon atoms, wherein $R^6$ is hydrogen, a hydroxyl containing hydrocarbyl having from 1 to about 20 carbon atoms, a hydrocarbyl primary amine having from 1 to about 20 carbon atoms, or a hydrocarbyl polyamine having from 1 to about 20 carbon atoms, and wherein the total number of $R^5$ and $R^6$ carbon atoms is 24 or less.

6. The composition according to claim 5 wherein Ar of said (A) compound is phenyl, wherein m is 1 or 2, wherein n is 1 or 2, wherein R° is H, wherein $R^1$ is an alkyl having from about 7 to about 20 carbon atoms, a cycloalkyl having from about 5 to 7 carbon atoms, or an alkenyl having from about 8 to about 20 carbon atoms or an alkyl substituted aromatic having from 7 to about 12 carbon atoms.

7. The composition according to claim 6 wherein $R^4$ of said (C) hydroxyl containing amine is an alkylene having from 2 to about 6 carbon atoms, wherein $R^5$ is hydrogen or an alkyl having from 1 to about 20 carbon atoms, and $R^6$ is hydrogen, a hydroxyl containing alkyl having from 1 to about 20 carbon atoms, an alkyl primary amine having from 1 to about 20 carbon atoms, or an alkyl polyamine having from 1 to about 20 carbon atoms and wherein said cyclohydrocarbyl hydroxyl containing amine is a cycloalkyl hydroxyl containing amine having from 3 to about 6 carbon atoms.

8. The composition according to claim 7 wherein m of said (A) compound is 1, wherein n is 1 or 2, wherein $R^1$ is an alkyl having from about 7 to about 20 carbon atoms, X is O, and wherein $R^2$ and $R^3$ of said (B) compound is hydrogen.

9. The composition according to claim 8 wherein $R^4$ of said (C) hydroxyl containing amine is an alkylene having 2 or 3 carbon atoms, wherein $R^5$ is hydrogen or an alkyl having 1 or 2 carbon atoms, O is 1, and $R^6$ is a hydroxyl containing alkyl having 2 or 3 carbon atoms, an alkyl primary amine having 2 or 3 carbon atoms, or an alkyl polyamine having 2 or 3 carbon atoms.

10. The composition according to claim 9 wherein said (D) metal of said transition metal agent is copper, iron, manganese or combinations thereof and said (C) hydroxy containing amine compound is ethanol amine or diethanol amine.

11. The composition according to claim 10 wherein said (D) metal of said transition metal is copper and said (C) hydroxyl containing amine compound is ethanol amine.

12. The composition according to claim 1 wherein said (II) oxime has the general formula $$R^7-\overset{\overset{OH}{|}}{\underset{\underset{R^8}{|}}{Y}}-\overset{\overset{NOH}{\|}}{C}-R^9$$

wherein $R^7$, $R^8$ and $R^9$ independently are hydrogen or hydrocarbyl and Y is aromatic, alkylene, or cycloalkylene with the proviso that the carbon atoms to which the OH group is bonded is not more than three carbon atoms removed from the carbon atoms to which the oxime group is bonded.

13. The composition according to claim 12 wherein said oxime is represented by the following formula

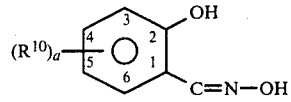

wherein $R^{10}$ is hydrocarbyl and a is 0, 1, 2, 3 or 4.

14. The composition according to claim 12 wherein said oxime is represented by the formula

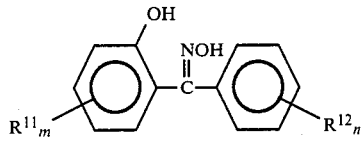

which $R^{11}$ and $R^{12}$ may be individually alike or different and are hydrocarbyl and m and n are 0, 1, 2, 3 or 4.

15. The composition according to claim 12 wherein said oxime is 5-nonylsalicylaldoxime, 5-heptylsalicylaldoxime, 5-dodecylsalicylaldoxime, 5-$C_{30}$ to $C_{200}$ polyisobutenyl salicylaldoxime, 2-hydroxy-3-methyl-5-ethylbenzophenoneoxime, 2-hydroxyl-3,5-dinonylbenzophenoneoxime, 2-hydroxy-5-dodecylbenzophenoneoxime or 2-hydroxy-5-nonylbenzophenoneoxime.

16. The composition according to claim 2 wherein said oxime is the oxime of claim 13 or claim 14.

17. The composition according to claim 8 wherein the oxime is the oxime of claim 13 or 14.

18. The composition according to claim 11 wherein the oxime is an oxime of claim 15.

19. A fuel additive concentrate comprising an organic solvent or diluent and from about 10% to about 99% by weight of the composition of claims 1, 4, 11, 15 or 18.

20. A fuel additive concentrate comprising an organic solvent or diluent and from about 10% to about 99% by weight of a fuel additive comprising a metal compound and an oxime.

21. The fuel additive concentrate of claim 20 comprising an organic solvent or diluent and from about 10% to about 99% by weight of a fuel additive comprising a metal compound wherein the metal of said metal compound is copper; the anionic portion of said metal compound is selected from oleate, naphthenate, succinate, and hydrocarbyl substituted succinate; and said oxime is selected from the group consisting of said oxime is 5-nonylsalicylaldoxime, 5-heptylsalicylaldoxime, 5-dodecylsalicylaldoxime, 5-$C_{16}$ to $C_{200}$ polyisobutenyl salicylaldoxime, 2-hydroxy-3-methyl-5-ethylbenzophenoneoxime, 2-hydroxyl-3,5-dinonylbenzophenoneoxime, 2-hydroxy-5-dodecylbenzophenoneoxime or 2-hydroxy-5-nonylbenzophenoneoxime.

22. A method for for obtaining a storage stable fuel composition comprising admixing to a major amount of a fuel a storage stable effective amount of the composition of claims 1, 4, 11, 15, or 18.

23. A method for obtaining a storage stable fuel composition comprising admixing to a major amount of a fuel a storage stable effective amount of the concentrate of claims 20 or 21.

24. The method of claim 22 wherein said fuel is diesel fuel or heating fuel oil.

25. The method of claim 23 wherein said fuel is diesel fuel or heating fuel oil.

* * * * *